US009692176B2

(12) United States Patent
Ray et al.

(10) Patent No.: US 9,692,176 B2
(45) Date of Patent: Jun. 27, 2017

(54) CONDUIT CONNECTION SYSTEM HAVING A PIVOTING HOUSING

(71) Applicant: TerraLUX, Inc., Longmont, CO (US)

(72) Inventors: Steven Howard Ray, Longmont, CO (US); Christopher M. White, Frederick, CO (US); Brett James Pardikes, Frederick, CO (US)

(73) Assignee: TerraLUX, Inc., Longmont, CO (US)

( * ) Notice: Subject to any disclaimer, the term of this patent is extended or adjusted under 35 U.S.C. 154(b) by 0 days.

(21) Appl. No.: 14/985,014

(22) Filed: Dec. 30, 2015

(65) Prior Publication Data

US 2016/0190737 A1 Jun. 30, 2016

Related U.S. Application Data

(60) Provisional application No. 62/097,822, filed on Dec. 30, 2014.

(51) Int. Cl.

| | |
|---|---|
| ***H01R 13/56*** | (2006.01) |
| ***H01R 13/627*** | (2006.01) |
| ***H01R 35/04*** | (2006.01) |
| *H01R 9/03* | (2006.01) |
| *H01R 13/74* | (2006.01) |

(52) U.S. Cl.

CPC ..... *H01R 13/6272* (2013.01); *H01R 35/04* (2013.01); *H01R 9/03* (2013.01); *H01R 13/746* (2013.01)

(58) Field of Classification Search

CPC ..... H01R 31/06; H01R 35/04; G02B 6/3829

USPC ..... 439/350, 446, 502, 607.42

See application file for complete search history.

(56) References Cited

U.S. PATENT DOCUMENTS

| | | | | |
|---|---|---|---|---|
| 1,187,010 | A * | 6/1916 | Rodrigues | H01R 13/5841 439/446 |
| 6,406,314 | B1 * | 6/2002 | Byrne | H01R 25/164 439/215 |
| 6,637,949 | B2 * | 10/2003 | Loch | G02B 6/4292 385/53 |
| 7,507,108 | B2 * | 3/2009 | Tsuji | H01R 13/5841 439/446 |
| 7,614,902 | B2 * | 11/2009 | Bayat | F21L 14/023 38/88 |
| 8,323,048 | B2 | 12/2012 | Zantout et al. | |

(Continued)

*Primary Examiner* — Vanessa Girardi

(74) *Attorney, Agent, or Firm* — Neugeboren O'Dowd PC

(57) ABSTRACT

An electrical connection system connecting a flexible conduit to electrical conductors, comprising a conduit portion and a removably attachable base portion. The conduit portion retains an end of the conduit, via a retention mechanism within a first housing at a first end. The conduit portion comprises a first electrical connector housing and electrical terminals within a second end of the first housing. The base portion comprises a base mount and a second housing having a first end pivotably connected to the base mount, the second housing being pivotable at a joint. The base portion may also comprise a second electrical connector housing and electrical terminals within a second end of the second housing for electrical connection to the conduit portion. Mechanical fastening components of the base portion and the conduit portion enable a mechanical connection between the base portion and the conduit portion.

18 Claims, 8 Drawing Sheets

(56) References Cited

U.S. PATENT DOCUMENTS

| | | | | |
|---|---|---|---|---|
| 8,777,671 | B2 * | 7/2014 | Huang | H01R 35/04<br>439/11 |
| 8,979,598 | B2 * | 3/2015 | Liao | H01R 31/06<br>439/730 |
| 9,325,134 | B2 * | 4/2016 | Lopez | H01R 35/00 |
| 2012/0028498 | A1 * | 2/2012 | Na | G09F 3/205<br>439/491 |

* cited by examiner

CONDUIT CONNECTION SYSTEM HAVING A PIVOTING HOUSING

PRIORITY

The present application for patent claims priority to U.S. Provisional Application No. 62/097,822 entitled "FLEXIBLE CONDUIT CONNECTOR" filed Dec. 30, 2014, and assigned to the Assignee hereof, the entire contents of which are hereby expressly incorporated by reference herein.

FIELD OF THE INVENTION

In various embodiments, the present disclosure relates to electrical and mechanical connectors, in particular to connectors for joining flexible conduit to a fixed surface.

BACKGROUND

A flexible electrical conduit (or simply, "flexible conduit") protects electrical conductors such as wires and cables from impact, moisture, and chemical vapors. Varying numbers, sizes, and types of conductors may be housed within a flexible conduit, which simplifies design and construction while maintaining some of the flexibility of the conductors themselves. However, challenges still arise when a flexible conduit must be electrically, mechanically, and thermally attached to a fixed surface of, for example, an electrical junction box or other housing, or a fixed component of an illumination device (such as a heat sink or control module). For example, inadequate strain relief at the connection point to a fixed surface may result in damage to the conductors during use. Relatedly, while the flexibility of the flexible conduit allows for some bending of the conduit during installation of the flexible conduit, connections to fixed surfaces typically require the flexible conduit to approach and connect to the surface in one particular direction. In addition, many conduit connectors require special tools or do not allow for easy disconnection of the flexible conduit once it is connected. And finally, maintaining a thermal path for heat dissipation through a conveniently removable connector that provides electrical and mechanical coupling can prove challenging.

In view of the foregoing, there is a need for improved conduit connectors that provide electrical and mechanical connections between flexible conduits and fixed surfaces, facilitate installation and removal of such conduits (and the components to which they are connected), provide a thermal pathway, and enable a variety of different approach and connection directions for the flexible conduit.

SUMMARY OF THE INVENTION

An aspect of the present disclosure provides an electrical connection system. The electrical connection system may first comprise a conduit-receiving portion, which itself may include a first housing that houses an end of the flexible conduit, and a retention mechanism that retains the end of the flexible conduit within a first end of the first housing. The conduit receiving portion may additionally comprise a first electrical connector housing, which itself may comprise one or more electrical terminals therein for electrical connection to one or more first electrical conductors, and which may be disposed at least partially within a second end of the first housing opposite the first end. Further, the conduit-receiving portion may also comprise a first fastening component for enabling mechanical connection to the first housing at the second end. A base portion may be removably attached to the second end of the conduit-receiving portion, the base portion comprising a base mount mechanically engageable with the base, and a second housing having a first end pivotably connected to the base mount. The second housing may be pivotable over at least 90° at a joint between the base mount and the second housing. The base portion may also comprise a second electrical connector housing comprising one or more electrical terminals adapted to connect to the one or more second electrical conductors, and may be disposed at least partially within a second end of the second housing opposite the first end. The second electrical connector housing of the base portion may be connectable to the first electrical connector housing of the conduit portion. Included in the base portion may also be a second fastening component disposed on the second end of the second housing, the second fastening component being cooperatively engageable with the first fastening component to form a mechanical connection between the conduit portion and the fixed portion.

Another aspect of the disclosure provides an electrical connection system. The electrical connection system may comprise a thermally conductive conduit-receiving portion that may include a first metal housing that retains an end of a flexible conduit, and a first electrical connector housing comprising one or more electrical terminals adapted to connect to one or more first electrical conductors. The system may also comprise a thermally conductive base portion including a base connector at a first end of the base portion, the base connector being mechanically connectable to a base. The thermally conductive base portion may also include a second electrical connector housing comprising one or more electrical terminals adapted to connect to one or more second electrical conductors, the second electrical connector housing being disposed at least partially within a second end of the base portion opposite a first end, the second electrical connector housing of the base being both connectable to the first electrical connector housing of the conduit portion and pivotable over at least 90° with respect to the base connector. The conduit-receiving portion and the base portion may be mechanically and removably engageable and provide a continuous thermal path from the flexible conduit through the base portion to the base when engaged.

Yet another aspect of the present disclosure provides an electrical connection system. The electrical connection system may first include a conduit-receiving portion, which itself may include a first housing that houses an end of the flexible conduit, and a retention mechanism that retains the end of the flexible conduit within a first end of the first housing. The conduit receiving portion may additionally comprise a first electrical connector housing, which itself may comprise one or more electrical terminals adapt to electrically connect to one or more first electrical conductors, and which may be disposed at least partially within a second end of the first metal housing opposite the first end. Further, the conduit-receiving portion may also comprise a first fastening component for enabling mechanical connection to the first metal housing at the second end. A base portion may be removably attached to the second end of the conduit-receiving portion, the base portion comprising a base mount mechanically engageable with the base, and a second housing having a first end pivotably connected to the base mount. The second housing may be pivotable at a joint between the base mount and the second housing. The base portion may also comprise a second electrical connector housing comprising one or more electrical terminals adapted to connect to the one or more second electrical conductors, and may be disposed at least partially within a second end of the second housing opposite the first end. The second electrical connector housing of the base portion may be connectable to the first electrical connector housing of the conduit portion. Included in the base portion may also be a second fastening component disposed on the second end of the second housing, the second fastening component being cooperatively engageable with the first fastening component to form a mechanical connection between the conduit portion and the fixed portion.

These and other objects, along with advantages and features of the disclosure, will become more apparent through reference to the following description, the accompanying drawings, and the claims. Furthermore, it is to be understood that the features of the various embodiments described herein are not mutually exclusive and can exist in various combinations and permutations. As used herein unless otherwise indicated, the terms "substantially" and "approximately" mean±10%, and, in some embodiments, ±5%. The term "consists essentially of" means excluding other materials that contribute to function, unless otherwise defined herein. Nonetheless, such other materials may be present, collectively or individually, in trace amounts.

DETAILED DESCRIPTION

Figures 1A, 1B:
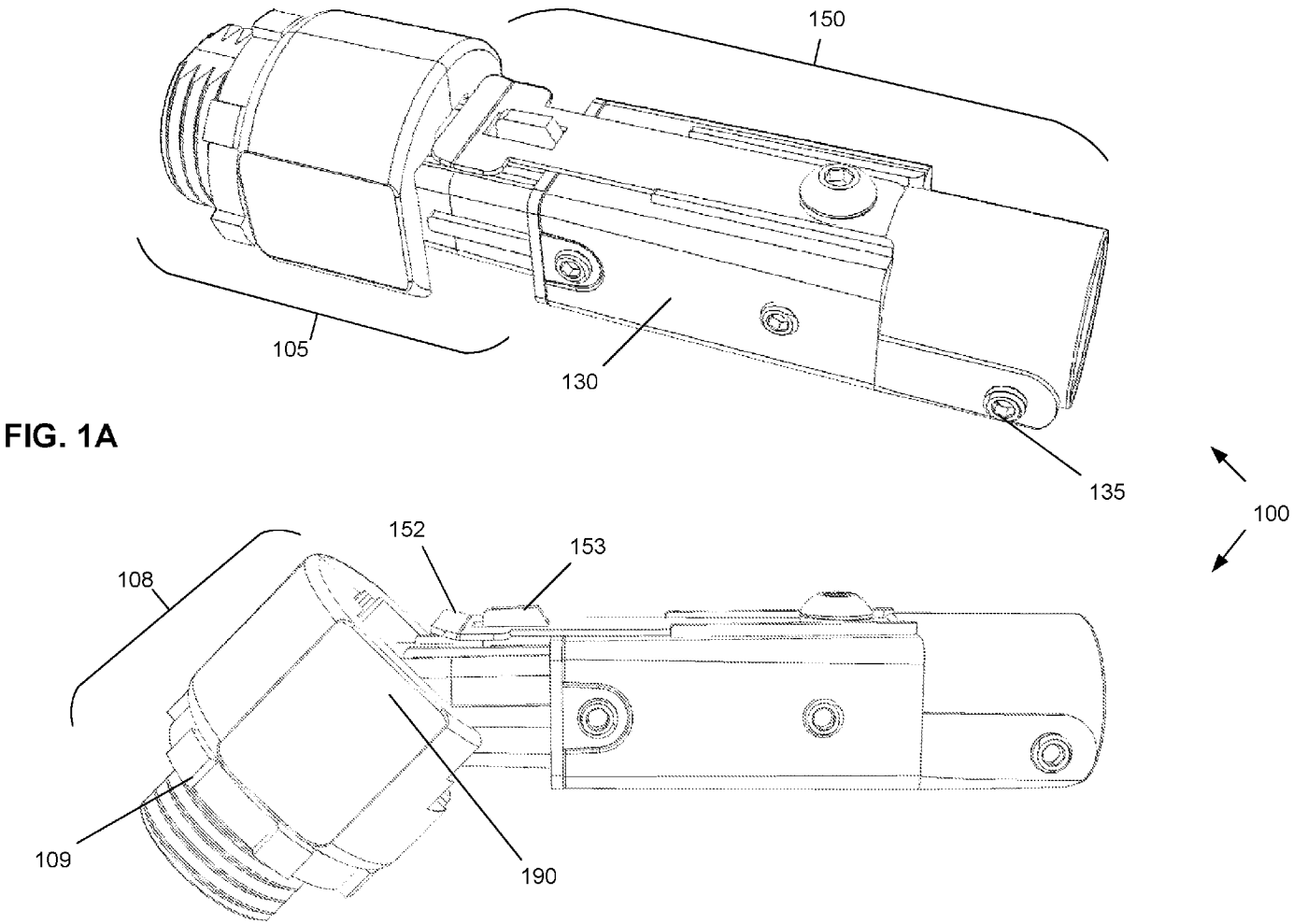
FIG. 1A shows a perspective side view of a connector system in a linear configuration in accordance with an embodiment of the present disclosure.
FIG. 1B shows a side view of the connector system of FIG. 1A in a bent position in accordance with an embodiment of the present disclosure.

FIGS. 1A and 1B illustrate an assembled and connected connector system 100 in accordance with various embodiments of the present disclosure. FIG. 1A shows the connector system 100 in a linear configuration, in which two portions of the connection system are extended in a straight line. FIG. 1B shows the same connector system 100 of FIG. 1A, but in a "bent" or "hinged" configuration, wherein two portions are oriented at an angle from one another. Reference numerals used to describe portions of either FIG. 1A or 1B refer to corresponding portions in the other figure. As shown, the first portion 150 of the connector system (or the "conduit end" or "conduit-receiving portion," or "conduit portion") connects to (referring briefly to FIG. 2) a flexible conduit 210, securing the end of the flexible conduit 210 within a metal housing 130 via a set screw 135 that engages the corrugated surface of the flexible conduit 210 and locks the conduit 210 in place. The first portion 150 of the connector system electrically and mechanically connects to a second portion 105 of the connector system (or the "base end" or "base portion"). A mechanical connection may be formed on the exterior of the connector system by, for example, a spring latch tab 152 coupled to a protrusion. The base portion 105 of the connector system 100 features a threaded base mount 108 that may be connected to a suitably threaded aperture in a fixed surface of a housing or an electrical component (i.e., a "base"). The threaded base mount 108 may be held in position relative to a base with the assistance of a lock nut 109. The base portion 105 provides the connector system 100 with the freedom to be rotated at least 90° about a pivot point 190, as will be described in further detail throughout the disclosure. In many embodiments, the threaded base mount 108 enables the entire connector system 100 to be swiveled to point to any position around a perimeter of a threaded aperture, as will also be described later in the disclosure. As a result, a flexible conduit may be attached to a fixed surface by the connector system 100 from a multitude of directions. In many embodiments, the conduit portion 150 and base portion 105 of the connector system 100 are at least partially made of metal to provide a continuous thermal path from the flexible conduit 210 to the fixed surface, and this thermal path is not materially disrupted by the pivot/swivel base mount—that is, the mechanical degree(s) of freedom provided by the pivot and/or swiveling mechanism do not substantially interfere with heat transfer therethrough. Furthermore, in embodiments in which the flexible conduit and the fixed surface are metallic or otherwise electrically conductive, the metallic first and second portions of the connector system enable the connector system, flexible conduit, and fixed surface to serve as a continuous electrical ground. However, it is contemplated that other types of materials, such as plastics and polymers, which may or may not possess heat-conducting properties, may be used to form connection systems according to the present disclosure.

Figure 2:
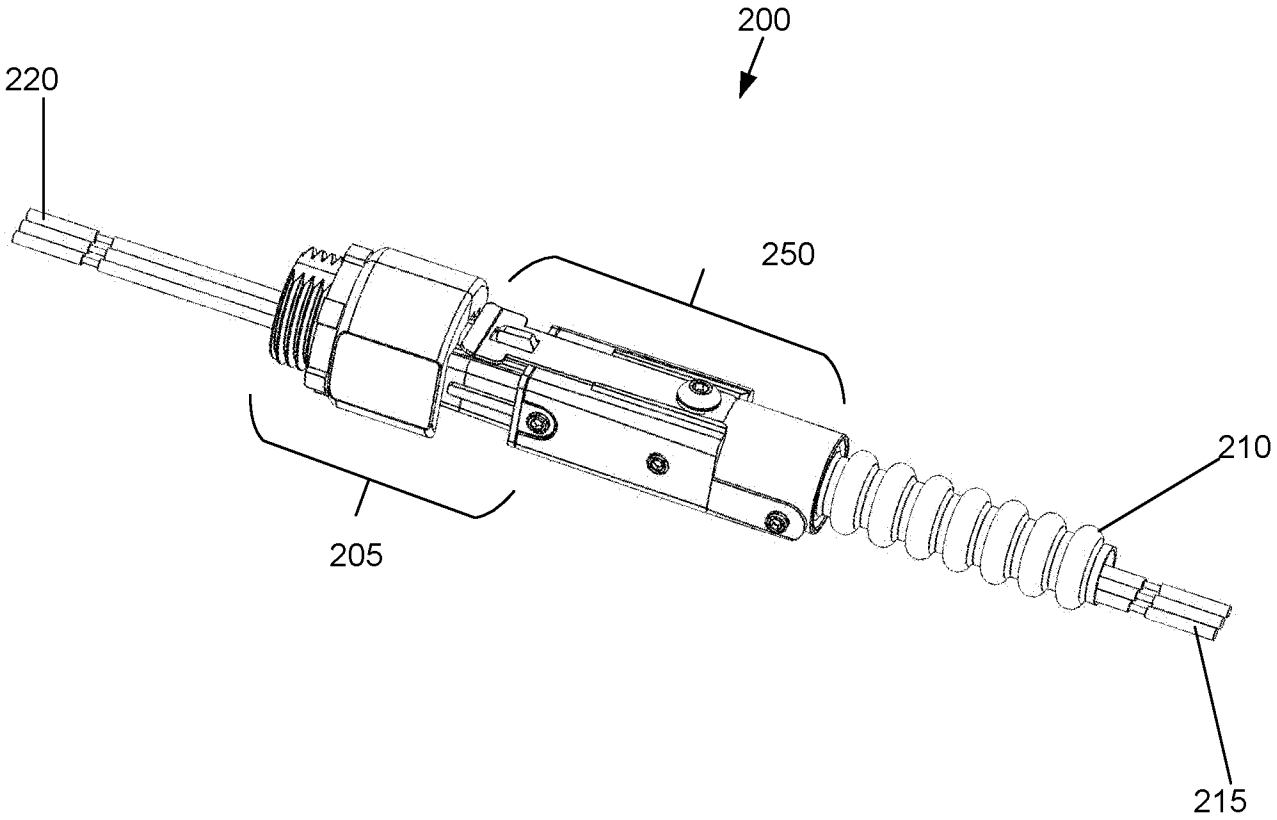
FIG. 2 shows a perspective view of a connector system with a flexible conduit and electrical wires connected by, and retained within the system.

FIG. 2 depicts the connector system 200 of the present disclosure with a flexible conduit 210 and a set of electrical wires (which may also be referred to as "electrical connectors") 220 protruding from either end. As shown, the electrical wires 220 enter the connector system 200 through the base portion 205. These electrical wires may originate in an electrical component such as a lighting device. The flexible conduit 210 enters the connector system 200 through the conduit portion 250. As shown, the flexible conduit 210 houses its own electrical wires 215, which may originate from, for example, a lighting device driver module. The electrical wires 215 from the conduit 210 may be connected to the electrical wires 220 from the fixed surface within the connector device 200.

Figure 3:
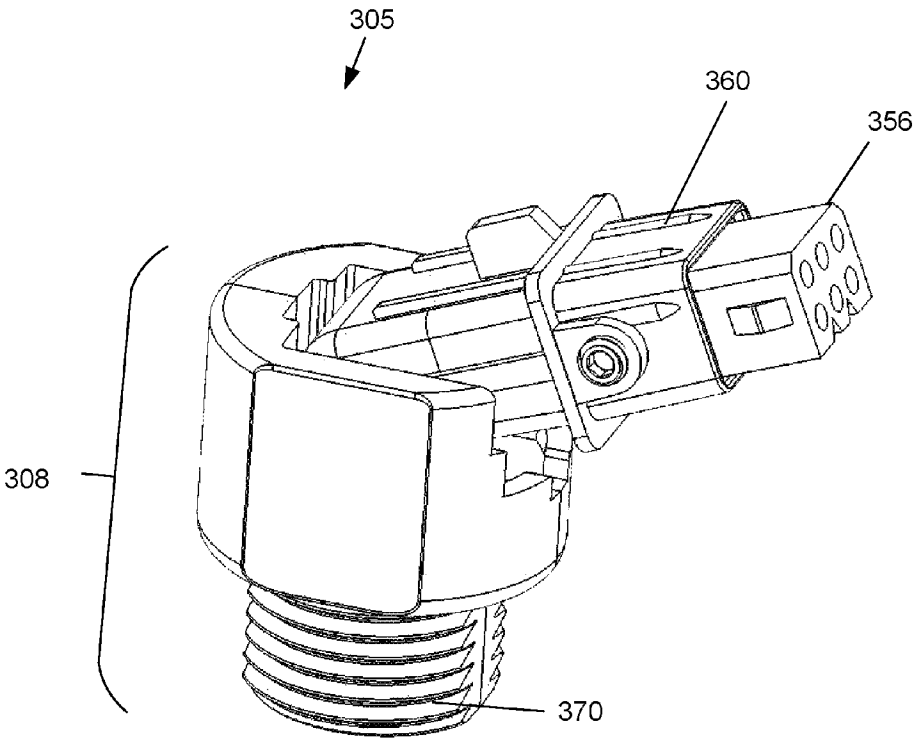
FIG. 3 shows a threaded base and a pivot housing portion which comprises a first end of the connector system.

FIG. 3 depicts an enlarged view of the base end 305 of the connection system in accordance with various embodiments of the present disclosure. As shown, an electrical connector housing 356 is recessed and retained within a pivot housing 360. The electrical connector housing 356 may be a standard electrical connector housing as known and used in the art for joining the ends of electrical wires, and may be press fit within the pivot housing 360. Electrical terminals of the electrical connector housing 356 are connected to electrical conductors coming from the fixed component (e.g., a junction box, an illumination device, or a module of an illumination device, not shown). The fixed end base mount 308 connects to the pivot housing 360 and allows the pivot housing 360 to pivot up to at least 90° around a pivot point. The fixed end base mount 308 also may have a threaded end 370 used to attach the fixed end 305 of the connection system to the fixed surface. In other embodiments, other forms of attachment to a fixed surface may be used instead of a threaded end, such as a smooth end that may be press fit into an aperture of a fixed surface. In many embodiments though, the threaded end 370 is made to be a size that fits many standard threaded apertures of electrical fixtures available in various industries. For example, the threaded end 370 may fit many existing heat sinks, mounting brackets, or light fixtures for existing recessed can lights in the residential and commercial lighting industry. The threaded base end 370 of the connector system may therefore provide ease of installation when installing new lighting systems or retrofitting existing lighting systems, even when products from various different manufacturers are used.

Figure 4:
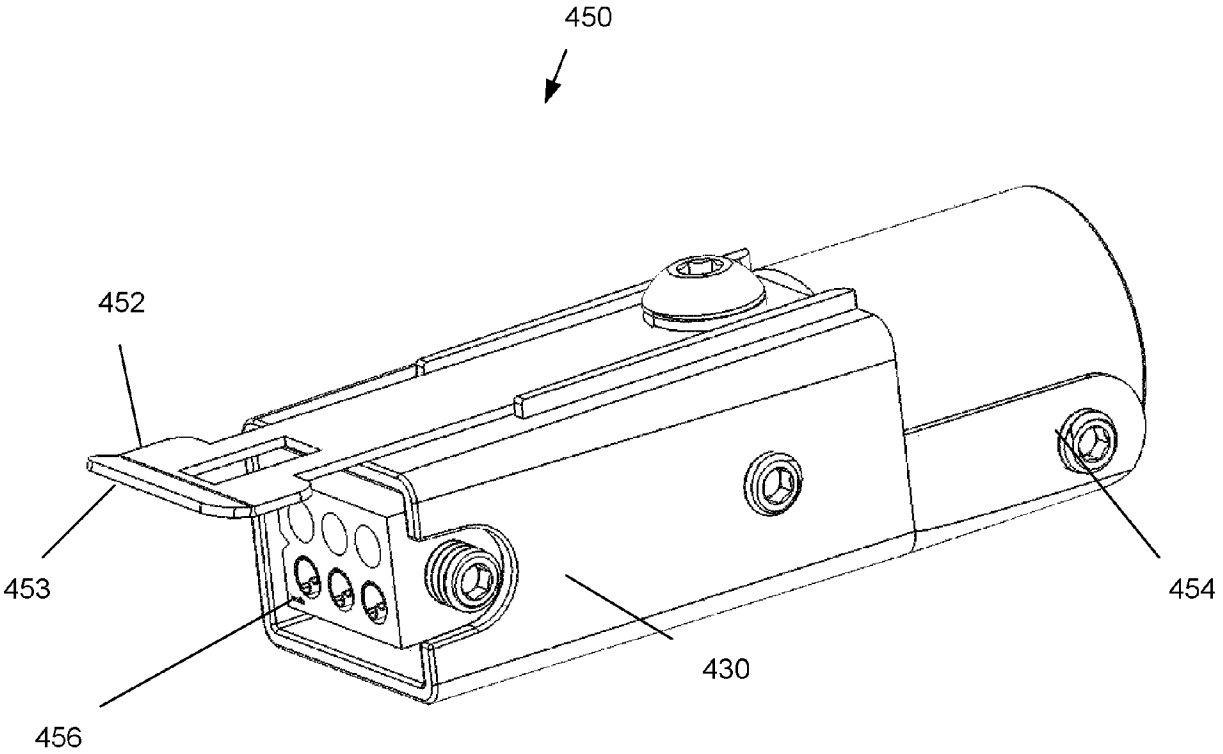
FIG. 4 shows a conduit retaining portion which comprises a second end of the connector system.

FIG. 4 depicts an enlarged view of the conduit end 450 (which corresponds to the conduit end 150 of FIG. 1) of the connection system in accordance with various embodiments of the present disclosure. As shown, an electrical connector housing 456 is recessed and retained within the conduit housing 430. Similarly to the base end 350 of FIG. 3, the electrical connector housing 456 may be press fit within the conduit housing 430. Electrical conductors are disposed within the flexible conduit (e.g., as shown in FIG. 2) and are attached to electrical terminals within the electrical connector housing 456, facilitating electrical connection to corresponding electrical conductors coming from the fixed component. A mechanical fastener such as a spring latch 452 may also be disposed on the conduit end 450 of the connection system, removably mating with a corresponding tab, protrusion or other fastening component on the fixed end of the connection system (e.g., as seen FIGS. 1 and 3). The mechanical fastener may be manually released by an installer or other user to purposely separate the conduit end 450 of the connection system from the fixed end; in the illustrated embodiment, the user may conveniently release the latch 452 by pulling the raised tab 453 at the end of the spring latch 452 with his or her thumb. As mentioned above, the flexible conduit is retained within the conduit housing 430 with, for example, a screw 454.

Figure 5A:
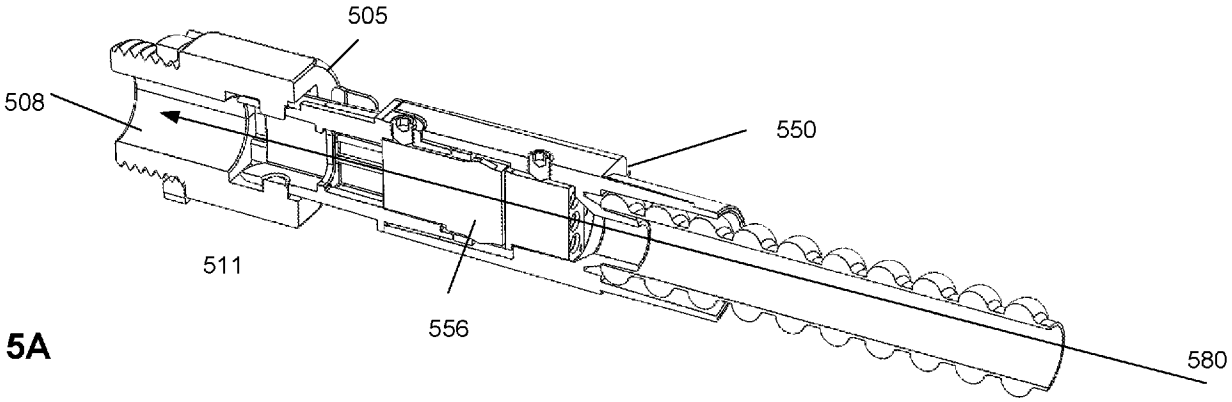
FIG. 5A shows a cross-section view of the connector system.
Figure 5B:
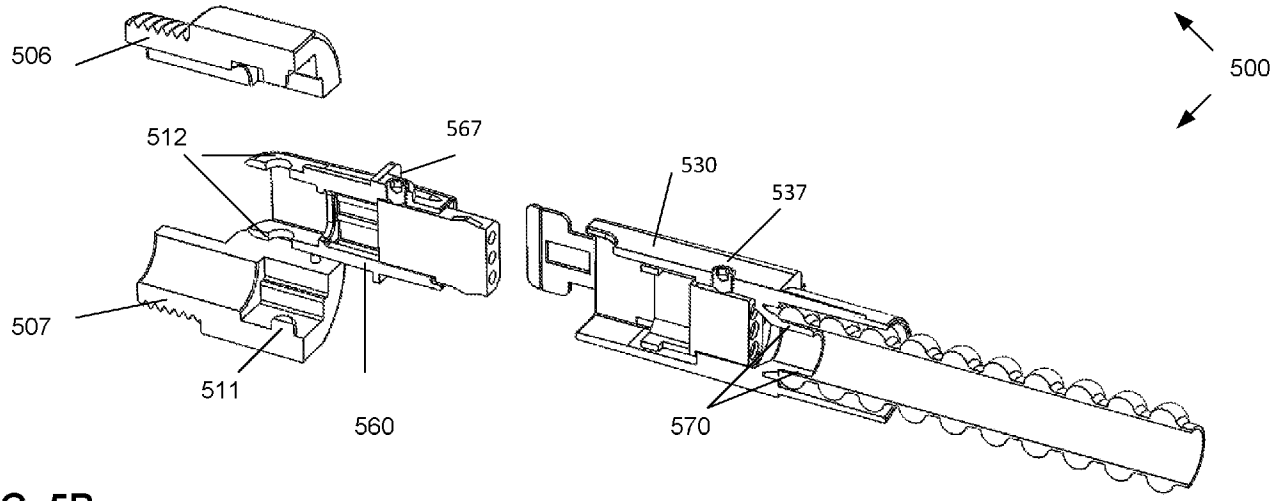
FIG. 5B shows a partially exploded cross-section view of the connector system.

FIG. 5A shows a cross-section view of the connection system 500, and FIG. 5B shows a partially exploded cross-section view of the same. As shown in FIG. 5B, the threaded base mount 508 may be constructed out of two separable halves 506 and 507, which may be joined together around the pivot housing 560. The two halves 506 and 507 each have a pin protrusion 511, which aligns with pin sockets 512. When as shown in FIG. 5A, the two halves 506 and 507 are joined around the pivot housing 560, the pin-and-socket mechanism allows the pivot housing 560 to pivot up to 90 degrees, in order to face a conduit in an optimal position. Another aspect of the disclosure is that the interior of the connector system 500 forms a contiguous hollow space through which electrical wires may run. That is, from the conduit end 550, through the electrical connector housing 556, to the base end 505, a path 580 allows the electrical wires to run through the connector system 500 in a manner such that air may flow around the wires at each point. As shown in FIG. 5A, the ends of the housings furthest away from the electrical connector housings are hollow, creating air space around the wires. The electrical connector housings, however, may naturally create a point of air flow constriction due to their shape. To allow for air flow throughout the connector system, in some embodiments, the air flow channels are created by unused holes within the electrical connector housings. For example, as shown in FIGS. 3 and 4, there are six holes in the electrical connector housings available for wires to run through. However, if less than six of the holes are actually used for wires, air may flow through the other unused holes. In other embodiments, a separate, dedicated air flow channel may be constructed elsewhere in order to allow air to flow through even if all of the electrical connector housing holes are utilized by wires. Having a contiguous air flow channel allows air to passively dissipate heat to out to the metal (or other heat-conducting material) components of the connector system. In some embodiments, it is contemplated that air may be forced through the connector system (e.g., by a driver module) in order to actively cool at least a portion of the connection system or the illumination system with which the connection system is utilized.

Another aspect of the present disclosure is that the mechanical connection of the connector system (e.g., the spring latch tab and protrusion) that surrounds the electrical connection between the electrical connector houses relieves strain on the wires that would otherwise result from pulling. As shown in FIG. 5B, one half of the electrical connector housing 560 is retained within the pivot housing 560. As previously mentioned, the electrical connector housing may be press fit within the pivot housing, but it is also retained by a screw or a pin 567. Similarly, the other half of the electrical connector housing 556 is retained in its conduit housing 530 by another screw or pin 537. When the ends of the connector system 500 are joined together, as shown in FIG. 5A, any forces that might pull on either end will be put primarily on the exterior mechanical connection, and not on the electrical connection that houses the wires. Additionally, the points of flexibility of the wires running through the system exist at locations spaced apart from the electrical connection between the joined wires. On the flexible conduit end, the flexibility points are in the conduit itself, and within the connector system, the flexibility point is at the pivot point.

Yet another aspect of the disclosure that is shown in FIGS. 5A and 5B is that the conduit-receiving portion 550 may comprise an internal flange or flanges 570, one end of which may originate from the conduit housing 530, and the other end of which may be inserted into the conduit between the outer wall and the wires of the conduit. Typically, an outer wall of a conduit is made of metal, and when the conduit is cut (for example, with a chop saw), sharp edges or burrs (tiny metal shards) may form at the end of the conduit. Such sharp edges or burrs may cut the hands of users, or may cut portions of the wires and cause shorts. The effects of sharp edges or burrs must typically be mitigated in some way, such as by manually de-burring the end of a conduit or covering it with a plastic bushing. An advantage of the internal flange 570 is protection of the wires of the conduit from any sharp edges or burrs from the outer wall without having to de-burr it or cover it with a plastic bushing. The internal flange 570 creates separation between the outer walls and the wires of the conduit, preventing burrs from falling on the wires, and the housing body 530 itself covers the edge of the cut conduit from users' hands.

Figure 6:
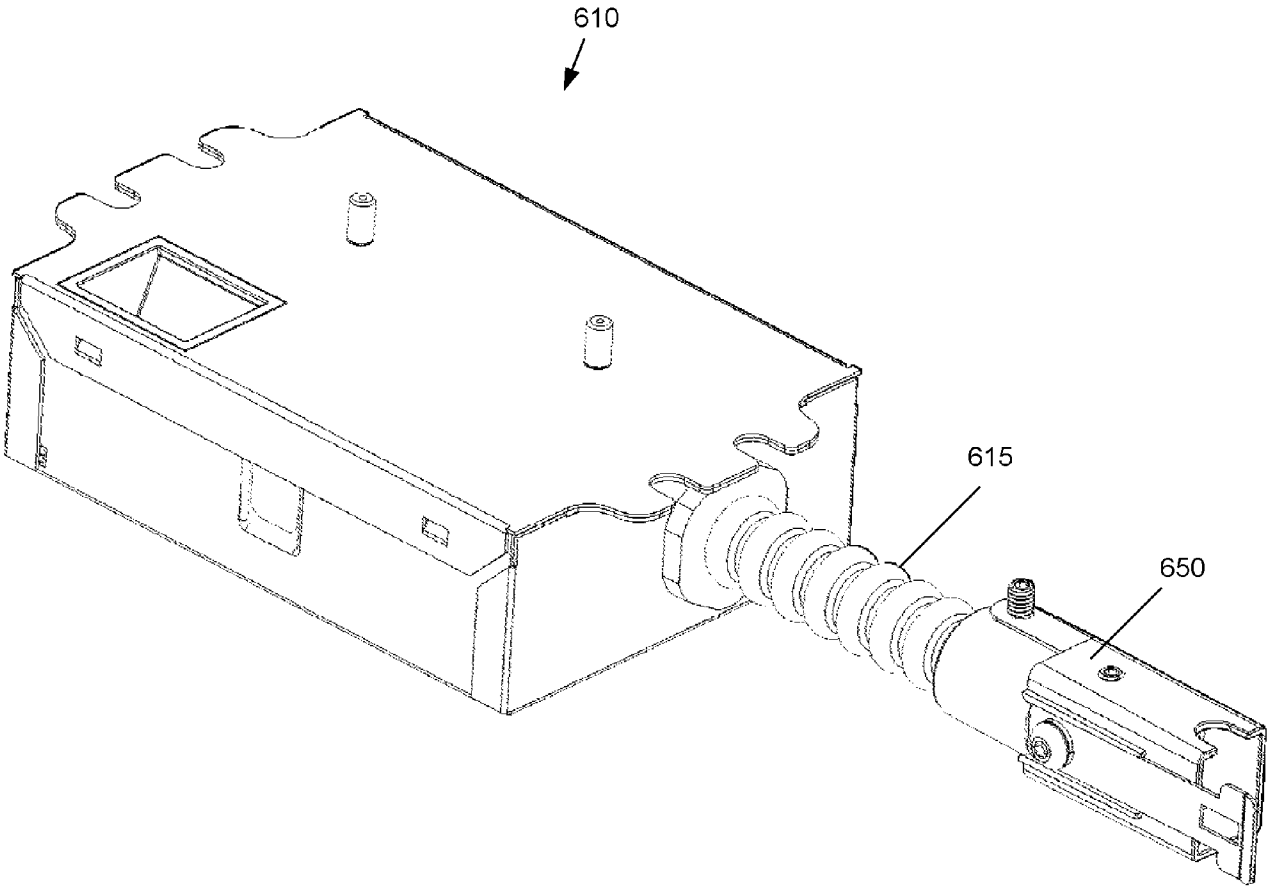
FIG. 6 shows a lighting device driver module with a conduit extending therefrom, attached to a conduit retaining portion of the connector system.

FIG. 6 depicts an exemplary lighting device driver module 610 which may be part of an illumination system that utilizes the connection system of the present disclosure. As shown, a conduit portion 650 of the connection system is attached to a flexible conduit 615. The corresponding base portion to the conduit portion may be seen by referring briefly to FIG. 7A, in which a base portion 705 is shown attached to a heat sink 720. The heat sink 720 may be part of a light fixture, which may be seen by referring briefly to the light fixture 870 depicted in FIG. 8A. Therefore, the driver module 610 may be connected to the light fixture 870 via a connection between the conduit portion 650 and the base portion 805A. Examples of some illumination systems that may be utilized in conjunction with the connector system of the present disclosure are disclosed in U.S. patent application Ser. No. 14/660,159, filed Mar. 17, 2015, which is incorporated by reference herein in its entirety.

Referring back to FIG. 6, the driver module 610 may house circuitry for receiving power from a power source, and then for transforming such electrical power into a form suitable to drive a lighting device. For example, the driver may transform power from an AC mains to DC current. Although the connector system of the present disclosure may be used to connect many different types of devices with electrical wires, the connector system is particularly useful in applications connecting flexible conduits from driver modules to light fixtures (such as those utilizing LEDs). One reason it is useful is because a driver module may need to be positioned at a substantial distance and/or a variety of different positions in relation to a light fixture. As an example, when an installer of residential or commercial recessed lighting systems installs each driver and its corresponding recessed can downlight, the driver may need to be positioned near a power source of the AC mains, and the can downlight may need to be installed several feet away at the desired location of the light in a ceiling of the room. Several drivers may be installed near an AC mains power source in the ceiling, but its corresponding several cans will be positioned at spaces at varying angles and distances from each other. Another reason the connector system of the present disclosure is particularly useful is that the drivers, conduits, and can lights are almost always installed in crawl spaces above a ceiling. Such environments contain dust and insulation which could damage an electrical connection. Further, such space for installation are often difficult to access, requiring installers to reach through small spaces to attach components to each other. Once components are electrically attached to each other, installers may pull on one end to move a component of the lighting system to a particular location, which would normally create a strain on the connection and possibly cause it to become loose. Therefore, the electrical connector system of the present disclosure provides environmental and mechanical protection as well as ease of installation.

It is contemplated that to further enhance the benefit of ease of installation of entire illumination systems, the driver modules and light fixtures may be manufactured with one or both portions of the electrical connector systems already attached. For example, the driver module 610 may come assembled as shown, with the conduit portion 650 attached. A light fixture 880 may come assembled as shown in FIG. 8A, with the base portion 805A attached. One or both portions of the connector system may also be used to retrofit existing drivers or light fixtures in order to facilitate the installation of upgraded components of a lighting system.

Figure 7A:
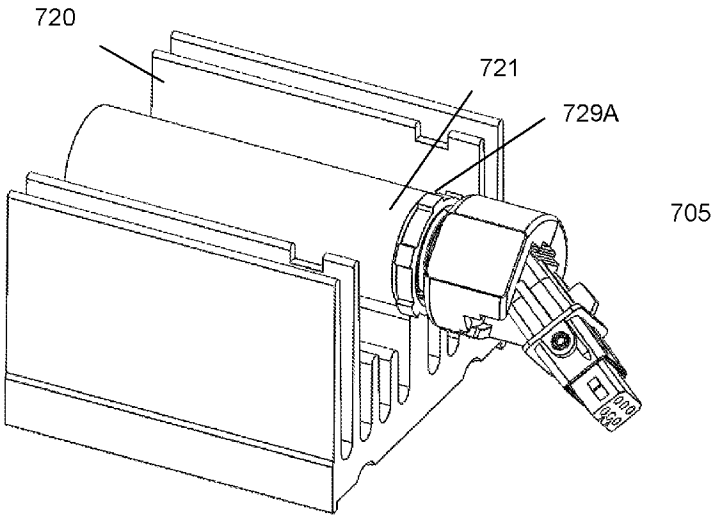
FIG. 7A shows a heat sink portion of a lighting device attached to the threaded base mount portion of the connector system.
Figure 7B:
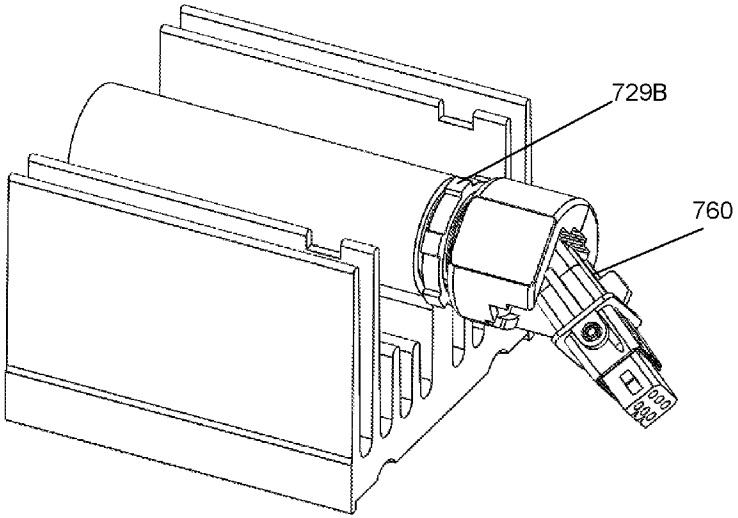
FIG. 7B shows the heat sink portion and threaded base portion of the connector system of FIG. 7A, with a lock nut in a different position than in FIG. 7A.

Turning now to FIG. 7A, shown is a base portion 705 threaded to a fixed surface, which in this figure comprises a heat sink 720 of a lighting device. Heat sinks are known in the art for dissipating heat generated by a light source, and are usually made of metal for the purposes of heat conduction. The heat sink 720 may be positioned within a light fixture as shown in FIG. 8A, which shows a heat sink 820 above a can downlight 885 and mounted within a mounting bracket 890. Referring back to FIG. 7A, the base portion 705 is shown threaded to a threaded aperture 721. Another aspect of the present disclosure is that the base mount may be rotated axially (i.e., swiveled) in order to allow the bent pivot housing 760 to be fixed to point in any direction 360 degrees around the circumference of the threaded aperture. The base mount may be fixed in place axially with a lock nut. In FIG. 7A, the lock nut 729A is depicted as flush against the threaded aperture 721, which tightens the base mount 705 in place axially. In FIG. 7B, the same lock nut 729B is shown spaced apart from the threaded aperture 721, showing that the base mount 705 may still be swiveled further to point the pivot mount 760 in a different direction. It is contemplated that in order to fix the base mount 705 in a particular axial position, a user may insert the base mount 705 into the threaded aperture 721 in an orientation near its final desired orientation, so that the threading mechanism and the lock nut 729A may each be rotated slightly to position the base mount 705 in its final desired orientation. Excessive rotation of the base mount 705 within the threaded aperture 721 (e.g., over 360°) may not be desirable because such rotation may cause twisting of the wires. No matter which direction the base mount 705 is oriented, though, the pivot housing 760 may still pivot freely.

Figure 8B:
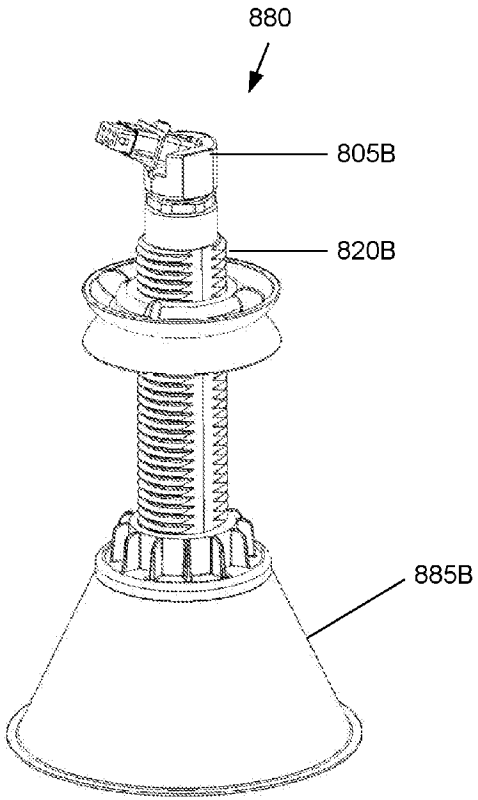
FIG. 8B shows another exemplary lighting device that may be used in accordance with the connector system of the present disclosure.
Figure 8A:
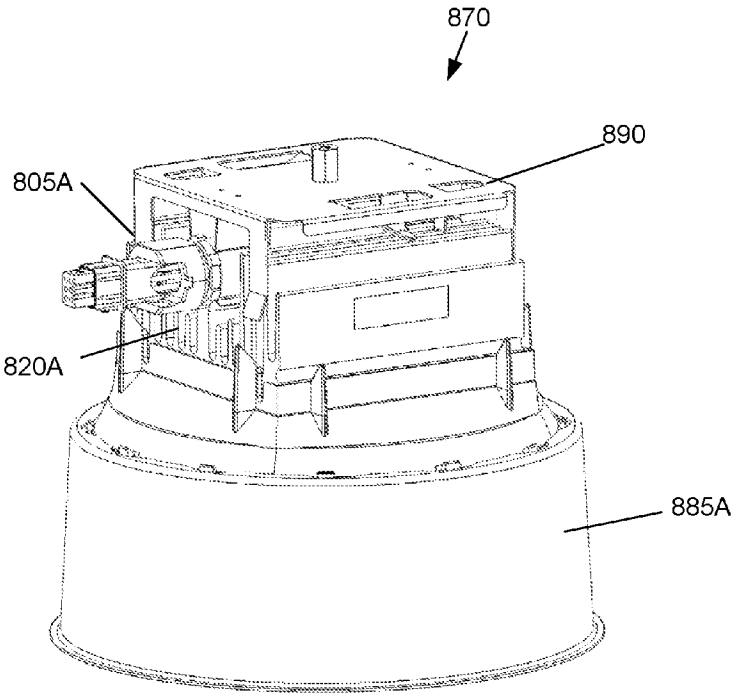
FIG. 8A shows an exemplary lighting device that may be used in accordance with the connector system of the present disclosure.

FIGS. 8A and 8B depict exemplary light fixtures 870 and 880 that may be used in conjunction with the connector system of the present disclosure. As shown, the base mount 805A is oriented horizontally and the base mount 805B is oriented vertically, in order to conform to the designs of the heat sinks 820A and 820B, respectively. Light fixture 870 is shown in a mounting bracket 890, which does not interfere with the connection point of the base portion 805A, and which would allow a conduit portion to be attached to the base portion 805A from substantially any direction. However, in some retrofit applications, wherein new drivers and light fixtures are to be installed, it may be practical to re-use existing mounting brackets. Sometimes, existing mounting brackets may have shapes and configurations that make it difficult to install new drivers and light fixtures because the connection points are hard to access. The connector system of the present disclosure provides a benefit in such circumstances because the connection points can be swiveled, rotated, and/or pivoted so that they are easier to access.

The wires that connect the light fixtures 870 and 880 to their respective drivers may perform a variety of functions, including supplying power from the drivers to the lights, transmitting sensed temperature information and thermal-foldback control signals from the lights to the drivers, and performing other functions necessary to control lighting features. It is contemplated that, similarly to the driver modules shown in FIG. 6, light fixtures 870 and 880 and other similar types may be manufactured and/or sold with one or more portions of the connector system assembled onto them. When possible, having the connector system pre-assembled onto the light fixture can reduce on-site installation time, because it can be time-consuming to manually insert wires coming out of a light fixture into the connector system. In installation jobs with many light fixtures, such time can be significant.

The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

What is claimed is:

1. An electrical connection system comprising:

a thermally conductive conduit-receiving portion including:

a first metal housing that retains an end of a flexible conduit, and a first electrical connector housing comprising one or more electrical terminals adapted to connect to one or more first electrical conductors; and a thermally conductive base portion including:

a base connector at a first end of the base portion, the base connector being configured to connect to an electrical light fixture;

a second electrical connector housing comprising one or more electrical terminals adapted to connect to one or more second electrical conductors, the second electrical connector housing being disposed at least partially within a second end of the base portion opposite a first end, the second electrical connector housing of the base portion being:

connectable to the first electrical connector housing of the conduit-receiving portion, and pivotable over at least 900 with respect to the base connector, wherein the conduit-receiving portion and the base portion are mechanically and removably engageable and provide a continuous thermal path from the flexible conduit through the base portion to the electrical light fixture when engaged.

2. The electrical connection system of claim 1, wherein the conduit-receiving portion and the base portion are mechanically and removably engageable and provide a continuous electrical path from the flexible conduit through the base portion to the electrical light fixture when engaged, the continuous electrical path being insulated from the first and second electrical conductors.

3. An electrical connection system comprising:

a conduit-receiving portion, the conduit-receiving portion including:

a first housing that houses an end of a flexible conduit, a retention mechanism that retains the end of the flexible conduit within the first housing at a first end of the first housing, a first electrical connector housing comprising one or more electrical terminals adapted to connect to one or more first electrical conductors, and being disposed at least partially within a second end of the first housing opposite the first end, and a first fastening component adapted to connect to the first housing at the second end; and a base portion removably attached to the conduit-receiving portion, the base portion including:

a base mount comprising a threaded portion and configured to connect to an electrical light fixture, a second housing having a first end pivotably connected to the base mount, the second housing being pivotable over at least 90 degrees at a joint between the base mount and the second housing, a second electrical connector housing comprising one or more electrical terminals and adapted to connect to one or more second electrical conductors, and being disposed at least partially within a second end of the second housing opposite the first end of the second housing, the second electrical connector housing being connectable to the first electrical connector housing, a second fastening component disposed on the second end of the second housing, the second fastening component being cooperatively engageable with the first fastening component to form a mechanical connection between the conduit portion and the base portion.

4. The electrical connection system of claim 3, wherein the first fastening component comprises a strike plate of a spring latch, and the second fastening component comprises a latch bolt of a spring latch.

5. The electrical connection system of claim 3, wherein the retention mechanism comprises a screw.

6. The electrical connection system of claim 3, wherein the electrical light fixture comprises a module of an illumination system.

7. An electrical connection system comprising:

a conduit portion including:

a first housing that houses an end of the flexible conduit, a retention mechanism that retains the end of the flexible conduit within the first housing at a first end of the first housing, a first electrical connector housing comprising one or more electrical terminals adapted to connect to one or more first electrical conductors, and being disposed at least partially within a second end of the first housing opposite the first end, and a first fastening component adapted to connect to the first housing at the second end; and a base portion removably attached to the conduit-receiving portion, the base portion including:

a base mount comprising a threaded portion and configured to connect to an electrical light fixture, a second housing having a first end pivotably connected to the base mount, the second housing being pivotable at a joint between the base mount and the second housing, a second electrical connector housing comprising one or more electrical terminals and adapted to connect to the one or more second electrical conductors, and being disposed at least partially within a second end of the second housing opposite the first end, the second electrical connector housing of the base portion being connectable to the first electrical connector housing, a second fastening component for enabling mechanical connection to the second housing at the second end thereof, the second fastening component being cooperatively engageable with the first fastening component to form a mechanical connection between the conduit portion and the base portion.

8. The electrical connection system of claim 7, wherein the base mount comprises two separable halves comprising pins, and the second housing comprises sockets, and when the two separable halves are joined together around the second housing, the pins and the sockets engage to form the joint around which the second housing is pivotable.

9. The electrical connector system of claim 7, wherein the conduit portion comprises an internal flange configured to be inserted between an outer wall and the electrical connectors conductors of the flexible conduit.

10. The electrical connection system of claim 7 wherein at least one of the first housing and the second housing is made of metal.

11. The electrical connection system of claim 10, further comprising a lock nut around the threaded portion of the base mount, and wherein the lock nut is configured to retain the base mount in a fixed place in any axial orientation relative to the electrical light fixture.

12. The electrical connection system of claim 7, wherein the electrical light fixture further comprises a driver module for the light fixture, and wherein the base portion is mechanically engaged to a heat sink of the electrical light fixture.

13. The electrical connector system of claim 12, wherein the conduit portion is pre-assembled to be attached to the driver module during manufacturing of the driver module.

14. The electrical connector system of claim 12, wherein the base-portion is pre-assembled to be attached to the light fixture during manufacturing of the light fixture.

15. The electrical connection system of claim 12, wherein the conduit portion is engaged to a flexible conduit that extends from the driver module.

16. The electrical connection system of claim 15, wherein the conduit portion and the base portion are mechanically and electrically connected, thereby electrically connecting the light fixture and the driver module.

17. The electrical connection system of claim 16, wherein a pathway for air flow exists around at least a portion of the electrical connectors within the connected conduit portion and base portion.

18. The electrical connection system of claim 17, wherein air is forced through at least a portion of the connected conduit portion and base portion by the drive module for cooling.

* * * * *